United States Patent [19]

Ogino et al.

[11] Patent Number: 5,046,341

[45] Date of Patent: Sep. 10, 1991

[54] CAR LOCKING DEVICE

[76] Inventors: Yozo Ogino, 1200 Nishiwari Shimojo, Okusamachi Nirasaki-shi, Yamanashi-ken; Kazuo Ogawa, 518-38 Higashinagaoka; Naoyoshi Morita, 115-1 Shimokobayashi, both of Oota-shi, Gunma-ken, all of Japan

[21] Appl. No.: 463,200

[22] Filed: Jan. 10, 1990

[30] Foreign Application Priority Data

Jan. 19, 1989 [JP] Japan ..... 1-10625

[51] Int. Cl.[5] ..... E05B 53/00

[52] U.S. Cl. ..... 70/264; 70/279; 70/241; 292/216; 292/280

[58] Field of Search ..... 70/263, 264, 265, 279, 70/240, 241; 292/DIG. 26, DIG. 43, 216, 280

[56] References Cited

U.S. PATENT DOCUMENTS

| | | | |
|---|---|---|---|
| 3,190,682 | 6/1965 | Fox et al. | 292/216 |
| 3,667,792 | 6/1972 | Torll | 292/DIG. 26 X |
| 3,695,660 | 10/1972 | Fetters | 292/216 |
| 3,835,678 | 9/1974 | Meyer et al. | 70/241 |
| 3,999,791 | 12/1976 | Torll | 292/280 X |
| 4,005,887 | 2/1977 | Itakura | 292/216 |
| 4,364,249 | 12/1982 | Kleefeldt | 70/264 |
| 4,652,027 | 3/1987 | Quantz | 70/241 X |
| 4,667,990 | 5/1987 | Quantz | 70/241 X |
| 4,948,184 | 8/1990 | Weyerstall et al. | 292/216 |

FOREIGN PATENT DOCUMENTS

| | | | |
|---|---|---|---|
| 299864 | 1/1989 | European Pat. Off. | 70/241 |
| 3612306 | 10/1987 | Fed. Rep. of Germany | 70/264 |
| 206572 | 11/1984 | Japan . | |

*Primary Examiner*—Robert L. Wolfe
*Assistant Examiner*—Suzanne L. Dino

[57] ABSTRACT

The car locking device of the present invention has a latch to be engaged with a striker, a ratchet for preventing the reversal of said latch, an opening lever for disengaging said ratchet from said latch, a locking lever for changing over said intermediate lever and said opening lever between an engaged state (unlocked state) or a disengaged state (locked state), and the first and second change-over levers. The key device of a door is connected to said first change-over lever, and said locking lever is connected to said second change-over lever. Said first and second change-over levers are rotationally moved together by key operation between the locking position and the unlocking position, and in the case of the excessive turn beyond the unlocking position, the first change-over lever only is rotationally moved, with said second change-over lever and said lock lever kept stationary. The excessive turn of said first change-over lever is detected by a switch, and when the switch is turned "On", the locking devices of other doors are also interlocked to be changed over into the unlocked state.

4 Claims, 6 Drawing Sheets

CAR LOCKING DEVICE

INDUSTRIAL FIELD OF APPLICATION

The present invention relates to a car locking device, especially a car locking device having an action for changing over the locking device for a door into an unlocked state, and an action for changing over the locking devices for all the other doors into an unlocked state, when the locking devices are changed over into an unlocked state.

PRIOR ART

Japanese Patent Laid-Open No. 59-206572 describes, as shown in FIGS. 13 and 14, a car locking device, comprising a latch engaged with a striker fixed on a car body, a ratchet for preventing the reversal of said latch, an intermediate lever A connected with said ratchet, an opening lever B for turning said intermediate lever A in order to disengage said ratchet from said latch, a locking lever C for changing over said opening lever B and said intermediate lever A between an engaged state (unlocked state) and a disengaged state (locked state), a first change-over lever F which is connected with the key device of a door and which is for selectively turning and moving said locking lever C between a locking position D and an unlocking position E, an over-center spring G for keeping said change-over lever F in either the locking position D or the unlocking position E, a second change-over lever H connected to one end of said first change-over F, a coil spring I for keeping said second change-over lever H in the unlocking position E against the resiliency of said over-center spring G, and a switch J which is made "ON" when said second change-over lever H is turned excessively beyond the unlocking position E against the resiliency of the coil spring I, wherein when said switch J is made "ON", the locking devices of the other doors are also interlocked so as to be changed over into an unlocked state.

However, in the case of the conventional device, when the second change-over lever H is excessively turned by the key device in order to turn the switch "ON", the locking lever C is also excessively turned although not needed. Therefore, there exist such disadvantages that the key operation at the time of the excessive turn requires a greater effort and that the locking device must be large enough to provide the sufficient space for allowing the excessive turn of the locking lever C.

SUMMARY OF THE INVENTION

The present invention overcomes said disadvantages by connecting the key device to the first change-over lever and connecting the locking lever to the second change-over lever, so that although both the change-over levers may be turned interlocked during a normal operation, when excessive turn beyond the unlocking position to be made, the first change-over lever alone connected to the key device may be turned while keeping the second change-over lever connected to the locking lever stationary.

EMBODIMENT

Figure 1:
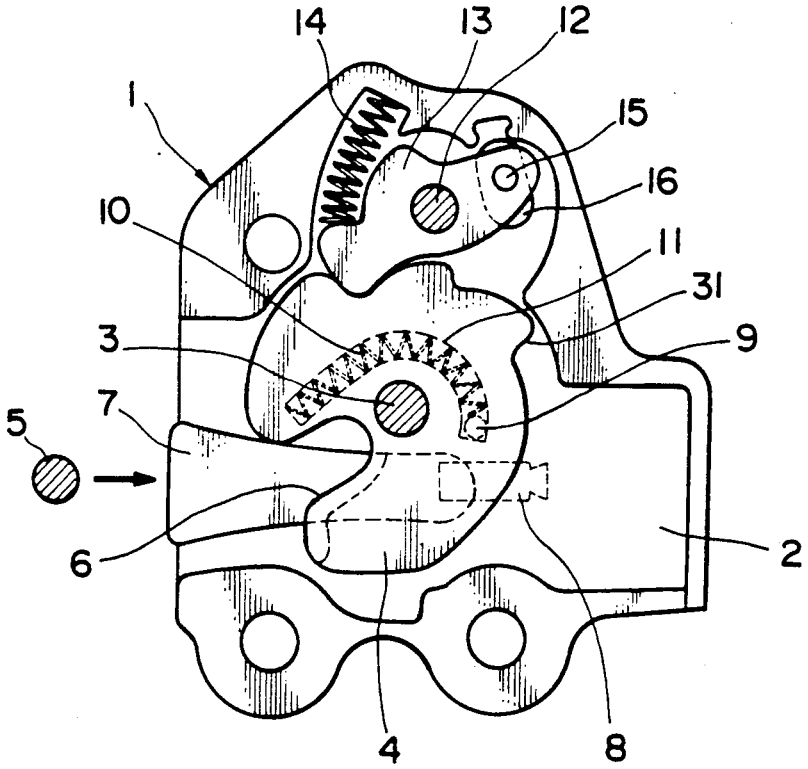
FIG. 1 is a front view of the locking device of the present invention.

An example of the present invention is described below based on drawings. On the front side of the synthetic resin body 1 of a car locking device, a recess 2 is formed, and it houses a latch 4 mounted on a shaft 3. The latch 4 has an engaging groove 6 to be engaged with a striker 5 fixed on the car. Symbol 7 stands for an access groove formed in the body 1 for the striker 5, and on the deepest end of the access groove 7, a cushioning material 8 to be brought into contact with the striker 5 is provided. On the body 1, an arcuate groove 11 is formed, and it houses a protrusion 9 protruding from the latch 4 and a spring 10, to apply clockwise action to the latch 4.

In the recess 2, a ratchet 13 for preventing the reversal turn of the latch 4 is mounted on a shaft 12. The ratchet 13 has a protrusion 15 protruding rearward through a slot 16 of the body 1. Symbol 14 stands for a spring acting on the ratchet 13.

Figure 2:
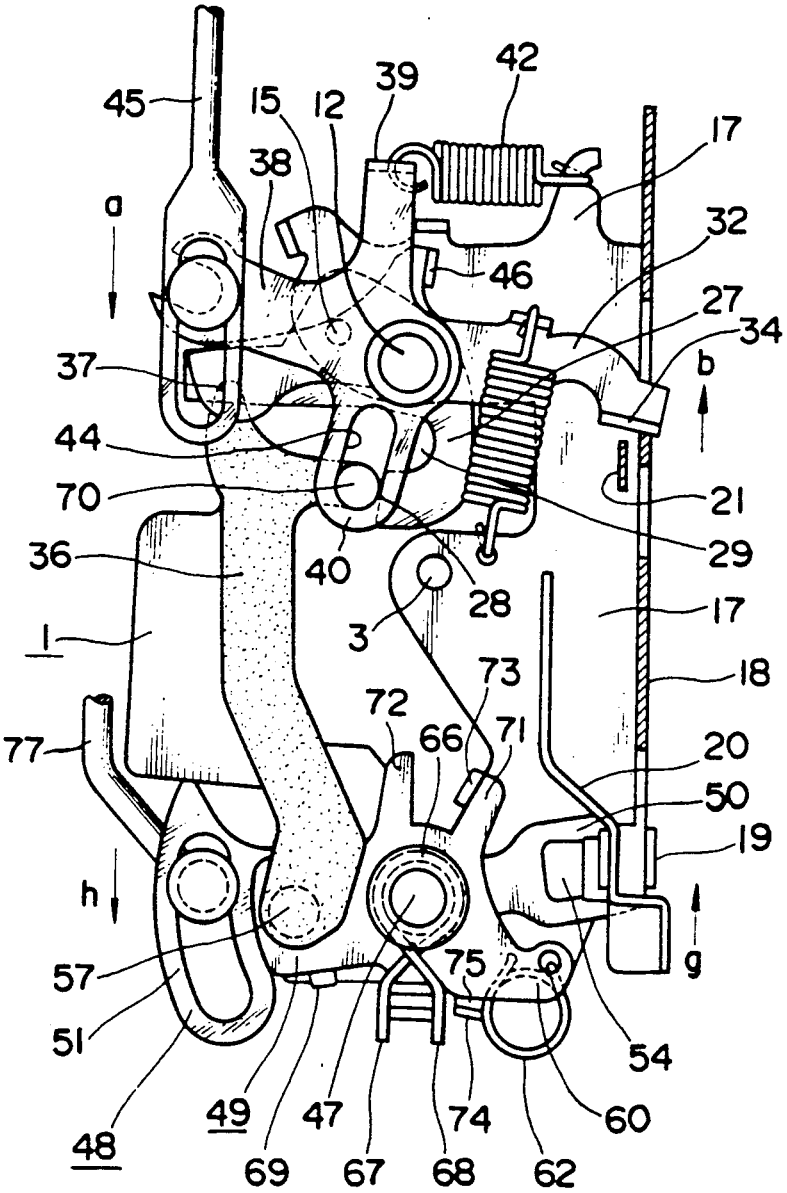
FIG. 2 is a rear view of the locking device.

FIG. 2 shows the rear side of the body 1 under an unlocked state. Said shaft 12 protrudes rearward through the body 1, and to the protrusion, an intermediate lever 27, a metallic back plate 17, a pivotally turning part 32 and an opening lever 38 are fitted in that order. The intermediate lever 27, the pivotally turning part 32 and the opening lever 38 are mounted rotatably on the shaft 12.

Figure 6:
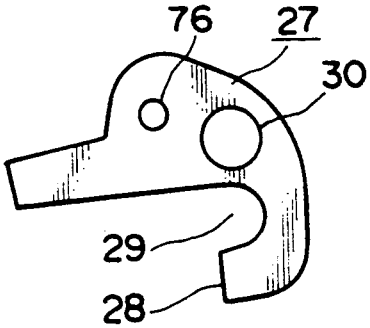
FIG. 6 is a front view of the intermediate lever.

The intermediate lever 27 is rotatably mounted on the shaft 12, and, as shown in FIG. 6, it has a contact portion 28, a recess 29, a shaft hole 30 into which the shaft 12 is inserted, and a connecting hole 76 engaged with the protrusion 15 of the ratchet 13. Therefore, if the intermediate lever 27 is turned, the ratchet 13 is turned through the protrusion 15 and is disengaged from an engaging step 31 of the latch 4.

The back plate 17 covers approximately half of the rear side of the body 1, and on one side of the plate 17, a riser portion 18 bent at a right angle is formed. On the bottom of the riser portion 18, an actuation lever 20 is mounted on a shaft 19, and at an upper position, an inner lever 21 connected to an inner opening handle (not illustrated) provided inside the door is mounted on a shaft (not illustrated).

Figure 3:
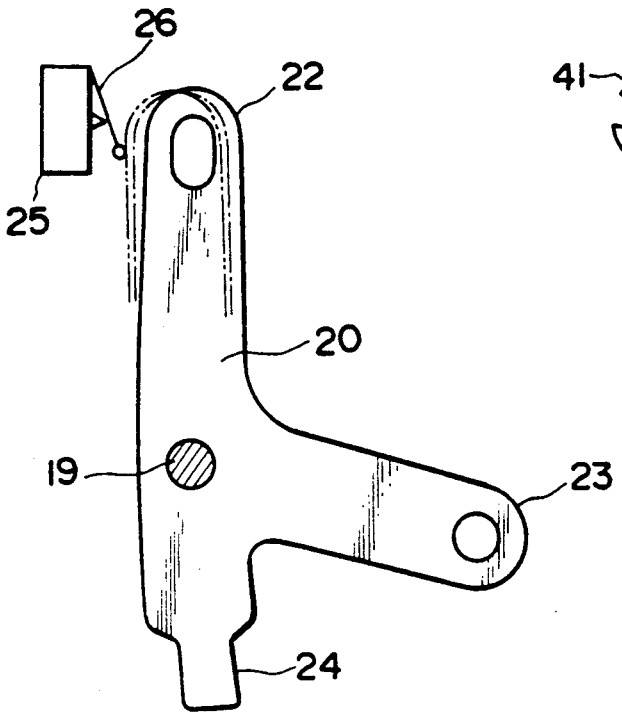
FIG. 3 is a front view of the actuation lever.

The actuation lever 20 has, as shown in FIG. 3, a first arm 22, a second arm 23 and a third arm 24. The first arm 22 or the second arm 23 is connected to an inside lock button (not illustrated) of the door. Near the first arm 22, a switch 25 described later is provided.

Figure 5:
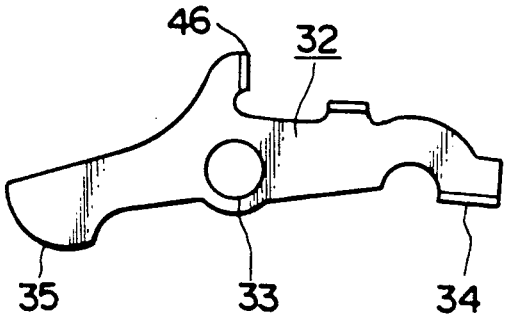
FIG. 5 is a front view of a pivotally rotating part.
Figure 7:
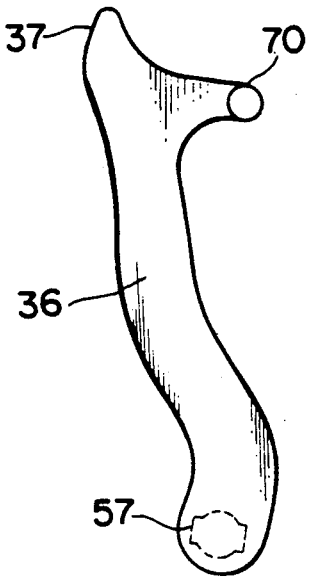
FIG. 7 is a front view of the locking lever.

The pivotally turning part 32 has, as shown in FIG. 5, a shaft hole 33 into which the shaft 12 is inserted, and a first end 34 is positioned near the inner lever 21. Therefore, when the inner lever 21 is moved in the direction of the arrow b by door-opening operation, it is brought into contact with the first end 34 of the pivotally turning part 32, and the pivotally turning part 32 turns counterclockwise in FIG. 2.

Figure 4:
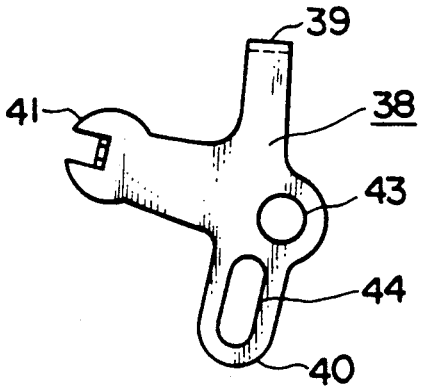
FIG. 4 is a front view of the open lever.

The opening lever 38 has such a structure as shown in FIG. 4, and it has a shaft hole 43 into which the shaft 12 is inserted, a first end 39, a second end 40 and a third end 41. Between the first end 39 and the back plate 17, a spring 42 is set (FIG. 2). The second end 40 has a slot 44 in the radial direction of the shaft hole 43. The third end 41 is connected to an outer rod 45 connected with an outer opening handle (not illustrated) provided outside the door. If the outer rod 45 is moved in the direction of the arrow a in FIG. 2, the opening lever 38 is turned counterclockwise around the shaft 12. Moreover, if the inner lever 21 is moved in the direction of the arrow b, the pivotally turning part 32 is turned counterclockwise, and the protrusion 46 of the pivotally turning part 32 is brought into contact with the open lever 38, to similarly turn counterclockwise.

Below the body 1, a shaft 47 is provided, and around the shaft 47, a first change-over lever 48 and a second change-over lever 49 for selectively changing over the locking device between a locked state and an unlocked state respectively are rotatably mounted.

Figure 9:
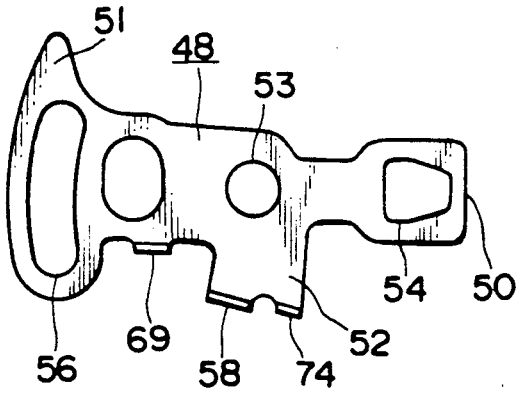
FIG. 9 is a front view of the first change-over lever.

The first change-over lever 48 has, as shown in FIG. 9, a shaft hole 53 into which the shaft 47 is inserted, a first end 50, a second end 51 and a third end 52. The first end 50 has an engaging hole 54 formed to be engaged with the third arm 24 of the actuation lever 20, and the second end 51 has an engaging hole 56 formed to be engaged with a rod 77 connected to the key device of the door. The third end 52 is formed like a fork, and on the respective tips, the protrusions 58 and 74 which erect at a right angle respectively are formed. On the underside of the first change-over lever 48, a protrusion 69 is provided.

Figure 8:
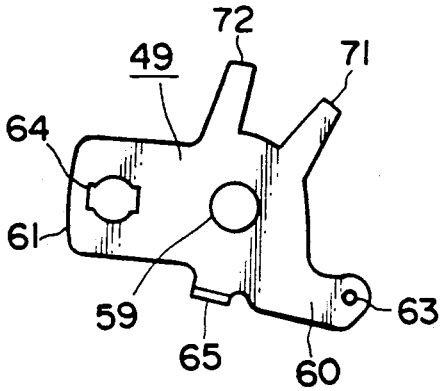
FIG. 8 is a front view of the second change-over lever.

On the first change-over lever 48, the second change-over lever 49 is overlapped. The second change-over lever 49 has, as shown in FIG. 8, a shaft hole 59 into which the shaft 47 is inserted, a first end 60 and a second end 61. On the under side of the second change-over lever 49, a protrusion 65 is provided at a position slightly inside the protrusion 58 of the first change-over lever 48. On the top of the second change-over lever 49, the engaging protrusions 71 and 72 forming a fork are formed, and a stop piece 73 formed on the metallic back plate 17 is positioned between the engaging protrusions 71 and 72. Therefore, the second change-over lever 49 is turned as long as the engaging protrusions 71 and 72 are in contact with the stop piece 73.

The engaging hole 63 of the first end 60 is locked by one end of the over-center spring 62, and the other end of the spring 62 is locked by the metallic back plate 17. The spring 62 becomes the dead point when the stopping piece 73 is located at an intermediate position between the engaging protrusions 71 and 72; and with the dead point as a border, the second change-over lever 49 is kept at either a position (unlocking position) where the engaging protrusion 71 and the stopping piece 73 are brought into mutual contact or a position (locking position) where the engaging protrusion 72 and the stopping piece 73 are brought into mutual contact. The engaging hole 64 of the second end 61 is locked by a pin 57 of the locking lever 36.

The shaft 47 has a clip spring 66 fitted around it, and one end 67 and the other end 68 of the clip spring 66 hold the protrusion 58 of the first change-over lever 48 and the protrusion 65 of the second change-over lever 49 between them. The resiliency of the clip spring 66 is weaker than that of the coil spring 62. Usually the first change-over lever 48 and the second change-over lever 49 have the protrusions 58 and 65 arranged straight by the clip spring 66 as shown in FIG. 10, and in this case, although there is no clearance between the protrusion 69 of the first change-over lever 48 and the second change-over lever 49, there is a clearance 75 formed between the protrusion 74 of the first change-over lever 48 and the second change-over lever 49 (FIGS. 10 and 12).

Figure 10:
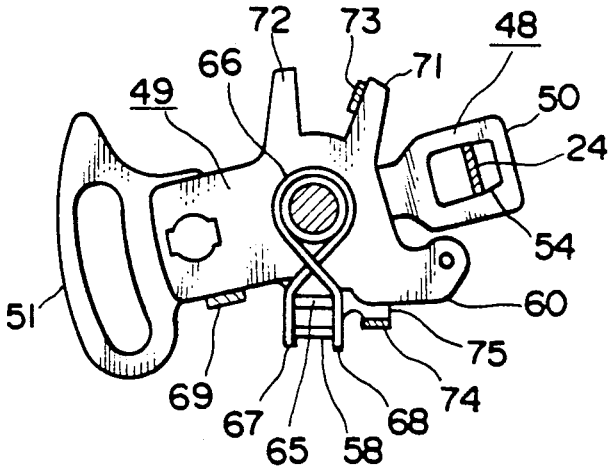
FIG. 10 is an illustration showing the change-over levers under an unlocked state.
Figure 12:
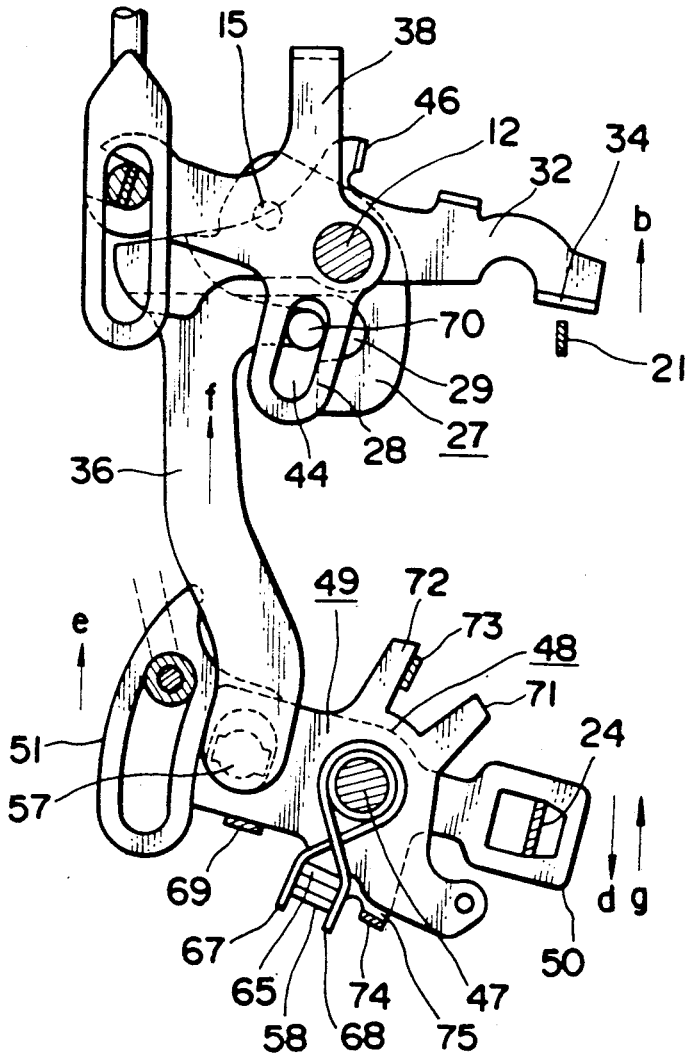
FIG. 12 is an illustration showing the relation of levers under a locked state.
Figure 13:
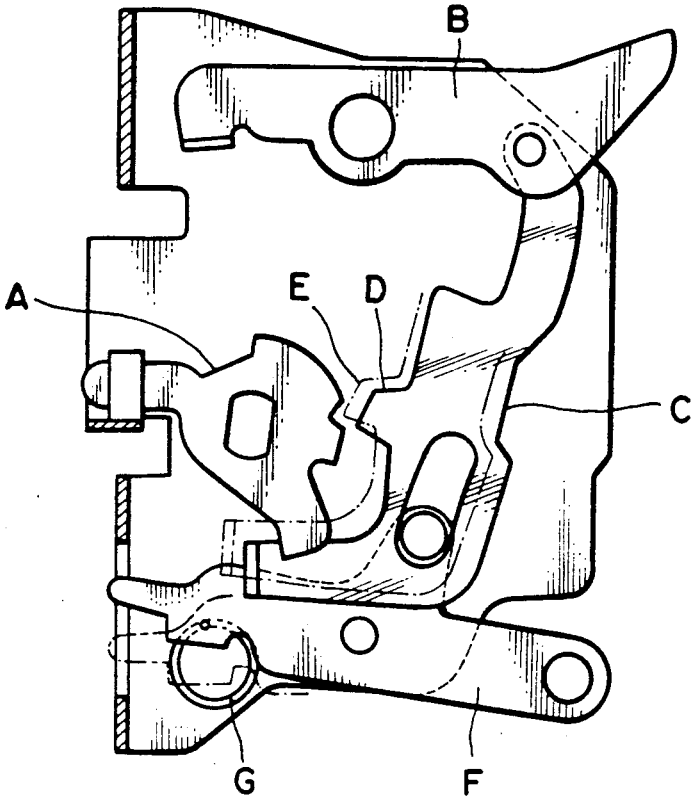
FIG. 13 (PRIOR ART)
FIGS. 13 and 14 are illustrations showing the prior art locking device of Japanese Patent Laid-Open No. 59-206572.
Figure 14:
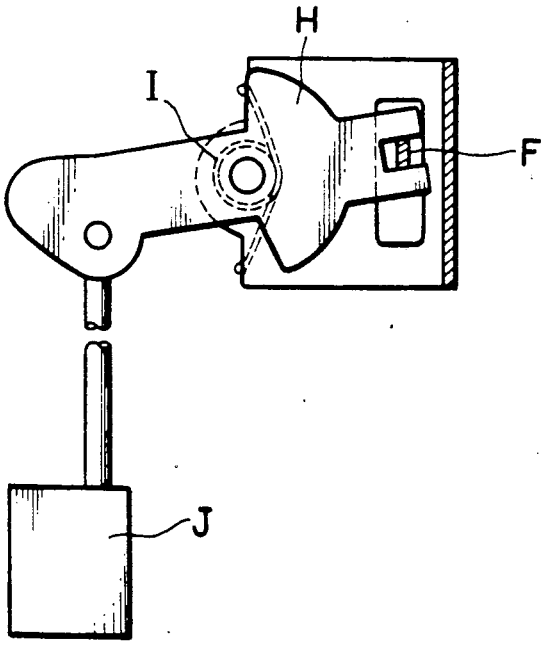
FIG. 14 (PRIOR ART)

Under the state of FIG. 10, if the first change-over lever 48 is turned clockwise, the protrusion 69 brought into contact with the second change-over lever 49 immediately turns the second change-over lever 40, but under the state of FIG. 12, when the first change-over lever 48 is turned conterclockwise, the second change-over lever 49 is held by the coil spring 62 till the protrusion 74 is brought into contact, and it does not turn. Furthermore, also under the state of FIG. 10 where the engaging protrusion 71 is kept in contact with the stopping piece 73, if the first change-over lever 48 is further turned counterclockwise, the first change-over lever 48 is turned excessively by an angle corresponding to the clearance 75.

The locking lever 36 has an engaging pin 70 formed on the top side 37 so as to be engaged with the slot 44 of the opening lever 38. When the engaging protrusion 71 and the stopping piece 73 are in mutual contact, the engaging pin 70 faces the contact portion 28 of the intermediate lever 27 (unlocked state) as shown in FIG. 2. Therefore, if the opening lever 38 is turned by the outer or inner opening handle under this state, the pin 70 is moved rightward according to the slot 44, to turn the intermediate lever 27 counterclockwise, and the ratchet 13 is turned, thus opening the door. On the contrary, when the engaging protrusion 72 and the stopping piece 73 are in mutual contact, the pin 70 faces the recess 29 of the intermediate lever 27 (locked state). Therefore, under this state, even if the pin 70 is moved rightward by turning the opening lever 38 by the outer opening handle, the pin 70 merely goes into the recess 29 without turning the intermediate lever 27, and hence, the door can not be opened.

When the opening lever 38 is rotated by the inner opening handle under the locked state, the second end 35 of the pivotally turning part 32 turned by the inner lever 21 is brought into contact with the locking lever 36, to turn the opening lever 38 and to move the locking lever 36 downward, and the pin 70 is moved into the unlocking position, and hence, the door can be opened.

Figure 11:
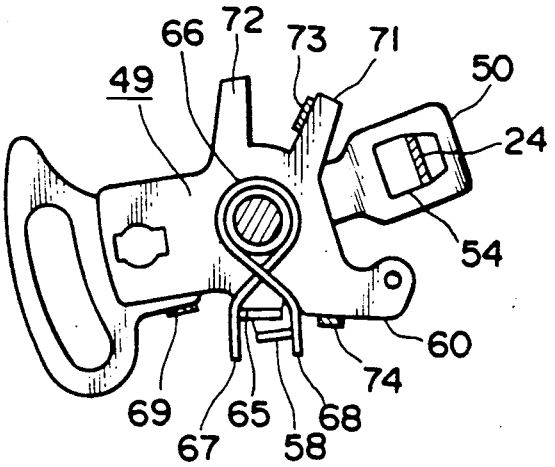
FIG. 11 is an illustration of the change-over lever excessively turned from an unlocking position.

The actuation lever 20 is positioned as shown by a solid line in FIG. 3 when the first change-over lever 48 is in the locking position of FIG. 12; and it is positioned as shown by the one-dot-dash line when the lever is in the unlocking position of FIG. 10. Besides, the first change-over lever 48 can be excessively turned from the unlocking position of FIG. 10 to the state of FIG. 11 due to the clearance 75, and the position of the actuation lever 20 in this case is as shown by the two-dot-dash line. The switch 25 is designed to be turned "ON" only when the first change-over lever 48 has been excessively turned to cause the actuation lever 20 to press a contact 26. The switch 25 is connected with the actuators of the locking devices of other doors, and if the switch 25 is turned "ON", the actuators are actuated to change over the other locking devices into an unlocked state.

The switch 25 is constituted so as to be changed over by the first arm 22, and as long as it can detect the excessive turn of the first change-over lever 48, it can be provided at any position.

Action

If the door is closed, the striker 5 goes into the guide groove 7 and is engaged with the engaging groove 6 of the latch 4, and the engaging step 31 of the latch 4 is engaged with the ratchet 13, to close the door.

Under this state, to switch the locking device into the locked state, the first change-over lever 48 is turned clockwise in FIG. 2 by the locking button or key of the door. As a result, the second change-over lever 49 engaged with the protrusion 69 is turned clockwise till the engaging protrusion 72 is brought into contact with the stopping pieces 73, and it is kept at the position by the spring 62. At a position where the engaging protrusion 72 is in contact with the stopping 73, the engaging pin 70 of the locking lever 36 moves upward in the slot 44 of the opening lever 38 and faces the recess 29 of the intermediate lever 27, to keep the locking device in the locked state (FIG. 12). Under this state, even if the outer rod 45 turns the opening lever 38 counterclockwise, the engaging pin 70 merely goes into the recess 29 without being brought into contact with the contact portion 28, and therefore, the door can not be opened.

To change over the locking device into the unlocked state, the first change-over lever 48 is turned counterclockwise in FIG. 12 by the locking button or key of the door. If the first change-over lever 48 is turned counterclockwise, the protrusion 74 is brought into contact with the second change-over lever 49, to turn the second change-over lever 49 counterclockwise. When the spring 62 is caused to go beyond the dead point by the turn of the second change-over lever 49, the second change-over lever 49 is moved into the unlocking position at a time by the resiliency of the spring 62, and the engaging protrusion 71 is brought into contact with the stopping piece 73 for stopping. When the second change-over lever 49 is set in the unlocking position, the locking lever 36 moves downward, and the engaging pin 70 is caused to face the contact portion 28 of the intermediate lever 27, to achieve the unlocked state of FIGS. 2 and 10. Under this state, when the opening lever 38 is turned counterclockwise by the outer rod 45, the engaging pin 70 is brought into contact with the contact portion 28, to turn the intermediate lever 27 counterclockwise. Therefore, the ratchet 13 is turned through the protrusion 15 and is disengaged from the latch 4, thus enabling the door to be opened.

Under this state, the second change-over lever 49 stops with the engaging protrusion 71 brought into contact with the stopping piece 73, and the protrusion 58 of the first change-over lever 48 and the protrusion 65 of the second change-over lever 49 are arranged straight by the action of the clip spring 66, to form the clearance 75 between the protrusion 74 and the second change-over lever 49.

Thus, when the locking device is switched into the unlocked state, the second change-over lever 49 stops once under the state of FIG. 10 with the engaging protrusion 71 brought into contact with the stopping piece 73, but when the first change-over lever 48 is further turned counterclockwise from this state, the first change-over lever 48 only is excessively turned by an angle corresponding to the clearance 75 till the protrusion 74 bumps into the second change-over 49 against the resiliency of the spring 66, although the second change-over lever 49 is kept stationary while in contact with the stopping piece 73. By this excessive turn, the actuation lever 20 engaged with the engaging hole 54 of the first change-over lever 48 can be turned to the position of the two-dot-dash line of FIG. 3, and the contact 26 is pressed by the first arm 22, to make the switch 25 into "ON". As a result, the actuators of the locking devices for other doors are actuated, to change over those locking devices into the unlocked state. If a hand is released, each of the locking devices immediately returns to the home position of FIG. 10.

Effect

In the case of the rotational displacement by the key operation between the locked state and the unlocked state, the locking lever is also moved vertically, but in the event that the rotational displacement by the key operation is made excessively, the first change-over lever only is turned, and hence, the locking lever is not moved vertically. Therefore, the key operation is light, and the locking device can be reduced in size by a space corresponding to the prevented excessive turn of the locking device.

We claim:

1. A car locking device, which is composed of a latch to be engaged with a striker fixed on a car body, a ratchet for preventing the reversal of said latch, an intermediate lever connected with said ratchet, an opening lever for turning said intermediate lever for disengaging said ratchet from said latch, a locking lever for changing over said intermediate lever and said opening lever between an engaged state (unlocked state) and a disengaged state (locked state), a change-over lever connected to the key device of a door in order to selectively and rotationally move said locking lever between the locking position and the unlocking position, and a switch to be turned "ON" when said change-over lever is excessively turned beyond the unlocking position, whereby when said switch is turned "ON", the locking devices of other doors are interlocked so as to be set into the unlocked state, comprising said change-over lever divided into a first change-over lever and a second change-over lever, said key device connected to the first change-over lever, and said locking lever connected to the second change-over lever, so that both said first and second change-over levers may be rotationally moved by key operation between the locking position and the unlocking position but so that in the case of the excessive turning beyond the unlocking position, said first change-over lever only may be rotationally moved.

2. A car locking device, which is composed of a latch to be engaged with a striker fixed on a car body, a ratchet for preventing the reversal of said latch, an intermediate lever connected with said ratchet, an opening lever for turning said intermediate lever for disengaging said ratchet from said latch, a locking lever for changing over said intermediate level and said opening lever between an engaged state (unlocked state) and a disengaged state (locked state), a change-over lever connected to the key device of a door in order to selectivity and rotationally move said locking lever between the locking position and the unlocking position, and a switch to be turned "ON" when said change-over lever is excessively turned beyond the unlocking position, whereby when said switch is turned "ON", the locking devices of other doors are interlocked so as to be set into the unlocked state, comprising said change-over lever divided into a first change-over lever and a second change-over lever, and said locking lever connected to the second change-over lever, so that both said first and second change-over levers may be rotationally moved by key operation between the locking position and the unlocking position but so that in the case of the excessive turning beyond the unlocking position, said first change-over lever only may be rotationally moved, and wherein said second change-over lever can be turned only between the locking position and the unlocking position, and said first change-over lever has a locking protrusion for turning said second change-over lever toward the locking side as soon as brought into contact with the second change-over lever when the first change-over lever is turned toward the unlocking side as soon as brought into contact with the second change-over lever when said first change-over lever is turned toward the unlocking side; and a clearance is provided between said unlocking protrusion and said second change-over lever in order to allow said excessive turn.

3. A car locking device, according to claim 2, wherein said second change-over lever is provided with an over-center spring for keeping said second change-over lever in either the locking position or the unlocking position.

4. A car locking device, according to claim 3, wherein said first change-over lever and said second change-over lever are connected by a return spring having resiliency weaker than that of said over-center spring.

* * * * *